US006220954B1

(12) United States Patent
Nguyen et al.

(10) Patent No.: US 6,220,954 B1
(45) **Date of Patent: *Apr. 24, 2001**

(54) MULTIDENOMINATIONAL COIN OUTPUT HOPPER

(75) Inventors: Binh Nguyen, Reno; John Leagh Beadell, Sparks; Daniel J. Waller, Reno, all of NV (US)

(73) Assignee: International Game Technology, Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/846,796

(22) Filed: Apr. 30, 1997

(51) Int. Cl.[7] ..... G07D 1/00
(52) U.S. Cl. ..... 453/57
(58) Field of Search ..... 453/33, 49, 57; 221/182, 265

(56) References Cited

U.S. PATENT DOCUMENTS 3,698,537 * 10/1972 Black et al. ..... 453/57
5,167,571 * 12/1992 Waller ..... 453/57 X
5,711,704 * 1/1998 Hughes et al. ..... 453/57

* cited by examiner

*Primary Examiner*—F. J. Bartuska
(74) *Attorney, Agent, or Firm*—George H. Gerstman; Seyfarth Shaw

(57) ABSTRACT

A coin output hopper capable of handling coins of different diameters and thicknesses is provided. A backplate is supported by a spring suspension to maintain the backplate substantially parallel to a rotating holeywheel/pinwheel despite misalignments, warping or other misshaping of the pinwheel. A coin guide is provided with a geometry to engage with different diameter coins so as to position the coins in the desired position within a coin pocket. A deflector is provided with a geometry which engages different diameter coins to accelerate coins along a knife edge exit path. The coins are forced along a path toward and along the knife edge by pins positioned such that excessive forces are avoided for any of a range of coin diameters.

9 Claims, 16 Drawing Sheets

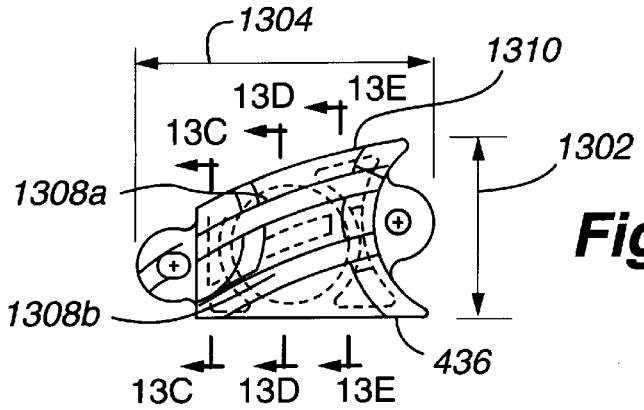
Fig. 13A
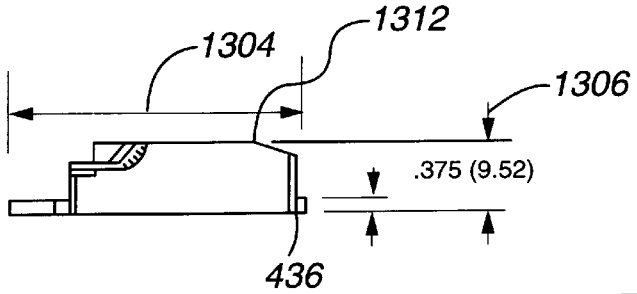
Fig. 13B
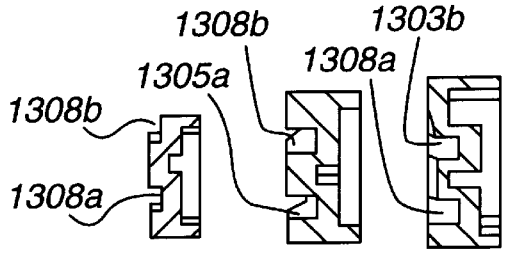
Fig. 13C
Fig. 13E
Fig. 13D
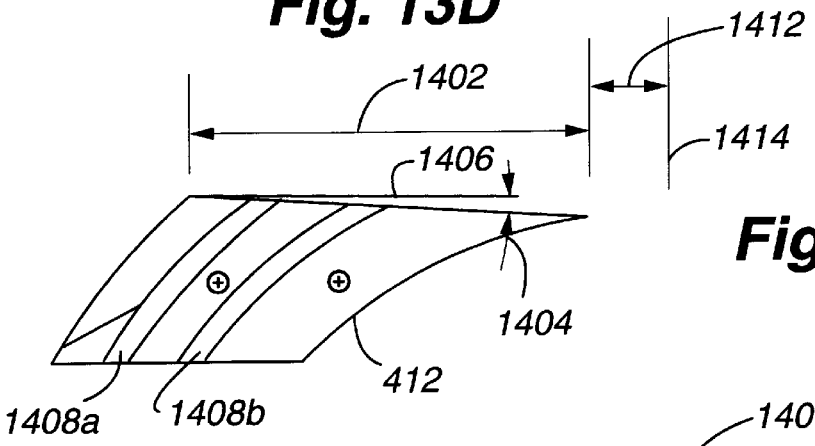
Fig. 14A
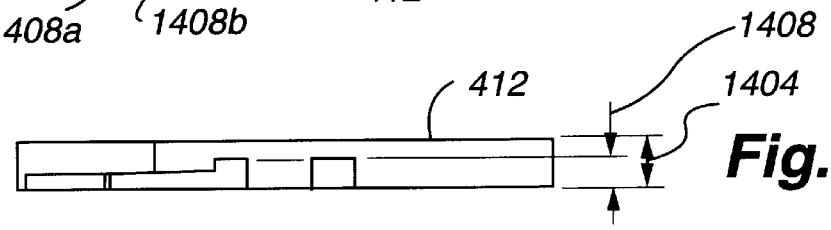
Fig. 14B

MULTIDENOMINATIONAL COIN OUTPUT HOPPER

FIELD OF THE INVENTION

The present invention relates to a coin handling machine and method and, in particular, to a device and method for a coin output hopper which accommodates any of a number of differently-sized coin denominations.

BACKGROUND OF THE INVENTION

Although coin handling devices are used for a number of purposes (including gaming devices, vending machines, coin counting devices and the like), coin handling in the gaming industry can generally be considered as relating to either or both of coin input (or acceptance) procedures and coin output (or payout) procedures. In a number of industries, including the gaming industry, coin output typically involves outputting coins of a single denomination from a hopper of coins containing a plurality of such single-denomination coins. In some cases, where output of two or more denominations is required, it may be necessary to provide two or more output hoppers, each of which contains a single denomination of coins. In any case, it is generally desired to provide a device for outputting a single denomination of coin which is as low-cost as possible (in terms of design, construction, maintenance, repair and operation) while having sufficient accuracy and reliability to avoid errors, down time and to minimize maintenance time and/or replacement parts.

Because it is, in general, difficult and expensive to design and construct devices for handling multiple denominations or sizes of coins, and because as noted above, gaming output hoppers typically handle only a single coin denomination, it is believed that most or all previous coin output hoppers, particularly in the gaming industry, are designed to handle only a single denomination of coin. Thus, typically, a coin output hopper designed to output, for example, "silver" dollar coins, would be physically distinct from a device for outputting, for example, quarters.

Even though the physical distinction between devices for handling different denominations may consist only in different dimensions of various components (i.e. devices for different denominations may operate on substantially the same theory), the design philosophy of using physically distinct devices for different denominations has led to relatively high costs associated with converting machines from one denomination to another denomination. For example, owing to factors such as changes in gaming preferences or popularity of various games, or owing to changes in typical coin population mixes (e.g. near international borders), it may, from time to time, be desirable to convert a gaming machine from one which outputs one denomination to a machine which outputs a different denomination. In the past, this has required replacing all of, or components of, the coin output hopper in such machines. It is believed that, in the past, the relatively high cost associated with denomination-conversion of machines was simply accepted and, as a result, it is believed little or no attention has been paid to design of multi-denominational output hoppers, particularly for gaming devices.

Accordingly, it would be useful to provide a coin output hopper which could reduce or eliminate costs associated with changing a gaming device or other coin handling machine from outputting one denomination to outputting another denomination, including the costs, in previous devices of replacing coin output hoppers or components thereof, costs of maintaining a relatively large inventory of coin output hoppers or components thereof, the cost of training personnel to perform such changes and the costs of training personnel to perform maintenance on a variety of different denomination output hoppers.

SUMMARY OF THE INVENTION

The present invention includes a recognition of problems in prior output hopper machines methods and approaches, including those noted above.

According to one aspect of the present invention, one or more coin-moving pins or pushers are positioned, with respect to a coin track or path so that, regardless of the size of the coin within the pocket (within a predefined range of sizes), the pin or pins contacting the coin at any given time during the transition of the coin onto a coin knife, is sufficiently close to a line passing through the center of the coin (and parallel to the knife edge) that force components parallel to the knife edge are sufficiently high (compared to orthogonal components) that any coin within the predefined size range will be transported along the knife edge with reduced or eliminated risk of coin jamming.

In addition to pin placement, a number of other features of the invention contribute to the ability to accommodate a range of coin sizes. Preferably, a stationary backplate is configured to substantially constantly follow or comply with a rotating pin wheel, regardless of any pin wheel misalignments or departures from planarity. A coin guide, intended to position or retain coins in a desired location within the coin path or track is shaped to achieve this function over a range of coin sizes, e.g. by configuring the guide such that larger-diameter coins are engaged near the leading edge of the guide while smaller-diameter coins are engaged closer to the trailing edge of the guide. Preferably the coin guide is also configured to reduce or eliminate entry (or attempted entry) of secondary and tertiary coins in the pocket.

A coin deflector is shaped to eject secondary or tertiary coins adjacent to the pocket entry hole, maintain coins properly situated in the pocket after or as they leave the influence of the coin guide and accelerate coins as they leave the hopper.

By providing a coin hopper which economically, reliably and accurately, accommodates a range of coin sizes, the present invention reduces or eliminates the need for replacing coin hoppers (or components thereof) when converting a machine from which outputs a first denomination to one which outputs a second denomination. Preferably, accommodation of a range of coin sizes is achieved without the need for adjustment or modification of the device with its attendant costs of down time and personnel training. Even in cases where the multi-denominational hopper does not span the entire size range of coins in a coin population, the present invention may, for example, allow manufacturers and/or casinos to reduce coin hopper inventory from the number needed to provide a separate hopper for each denomination to, e.g., two or three different hoppers with ranges which, together, cover the coin size range in a given coin population.

BRIEF DESCRIPTION OF THE DRAWINGS

FIG. 13A is an elevation view of a coin deflector according to an embodiment of the present invention;

FIG. 13B is a bottom view, partly cut away, of the deflector of FIG. 13A;

FIGS. 13C, D, and E are cross-sectional views taken along lines 13C—13C, 13D—13D and 13E—13E, respectively.

FIGS. 14A and 14B are elevational and top views of a coin knife according to an embodiment of the present invention;

DETAILED DESCRIPTION OF THE PREFERRED EMBODIMENT

Figure 1:
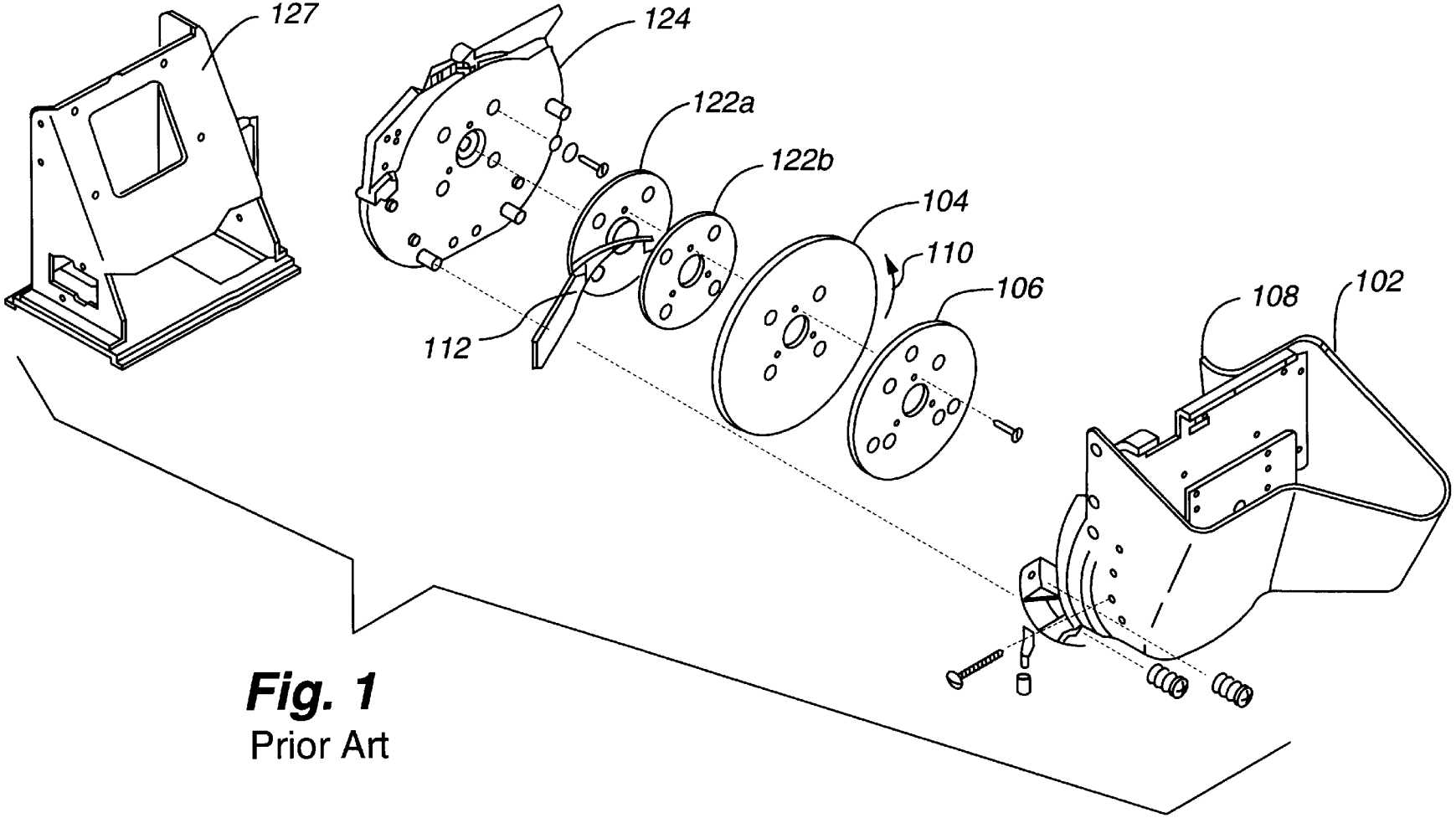
Fig. 1 Prior Art
FIG. 1 is an exploded perspective view of coin output hopper according to previous devices.

To assist in understanding the present invention, certain features of previous devices will first be described. According to one previous device depicted in FIGS. 1 and 2, a coin output hopper was configured to provide a bowl 102 having an opening (not shown) adjacent a portion of concentrically rotatable pin wheel 104 and shelf wheel 106. In the depicted configuration, coins in the bowl 102 exited the opening at the bottom of the bowl (not shown) and were constrained to an annular track defined by the edge of the pin wheel and central disk-like projection or shelf wheel positioned on the pin wheel.

In a circumferential direction, the coins were contacted and pushed by pairs of projecting pins of the pin wheel (see FIG. 2) to define, in cooperation with the annular track, a plurality of coin pockets. As noted above, the proper operation of this device required that all coins in the bowl should be of the same size and should be sized so as to substantially fit within the pocket, with relatively little play. In this way, as the rotating pin wheel and shelf wheel transported the coins, e.g. in a counterclockwise direction 110, the coins in the pockets eventually contacted the edge of knife 112 causing the coins to travel along the edge of the knife to be ejected from the hopper to the side.

Figure 2:
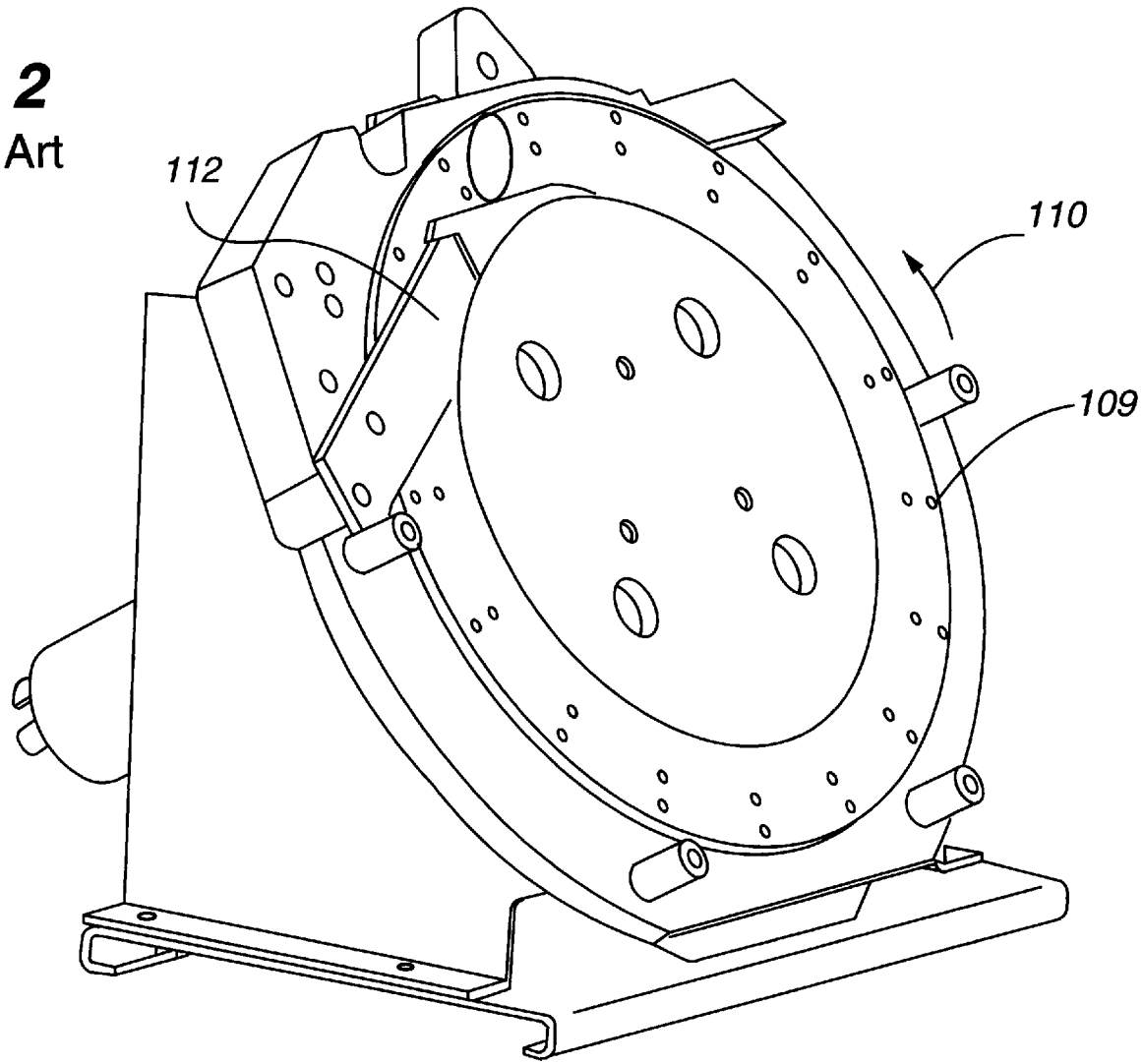
Fig. 2 Prior Art
FIG. 2 is a perspective view of the device of FIG. 1 assembled.

The pin wheel 104 and shelf wheel 106 are coupled by spacer wheel 122*a*, 122*b* to a main housing 124 which, in turn, is coupled to a chassis 127 so as to hold the pin wheel and shelf wheel at an angle, such as about 60 degrees from horizontal, as depicted in FIG. 2. The apparatus of FIG. 3 is similar to that of FIG. 1 except that a lower and upper escalator 126, 128 are positioned adjacent to the knife 112 and configured such that ejected coins are elevated by the escalator 126, 128 for delivery, e.g., to a conveniently-located coin tray (not shown).

Figure 3:
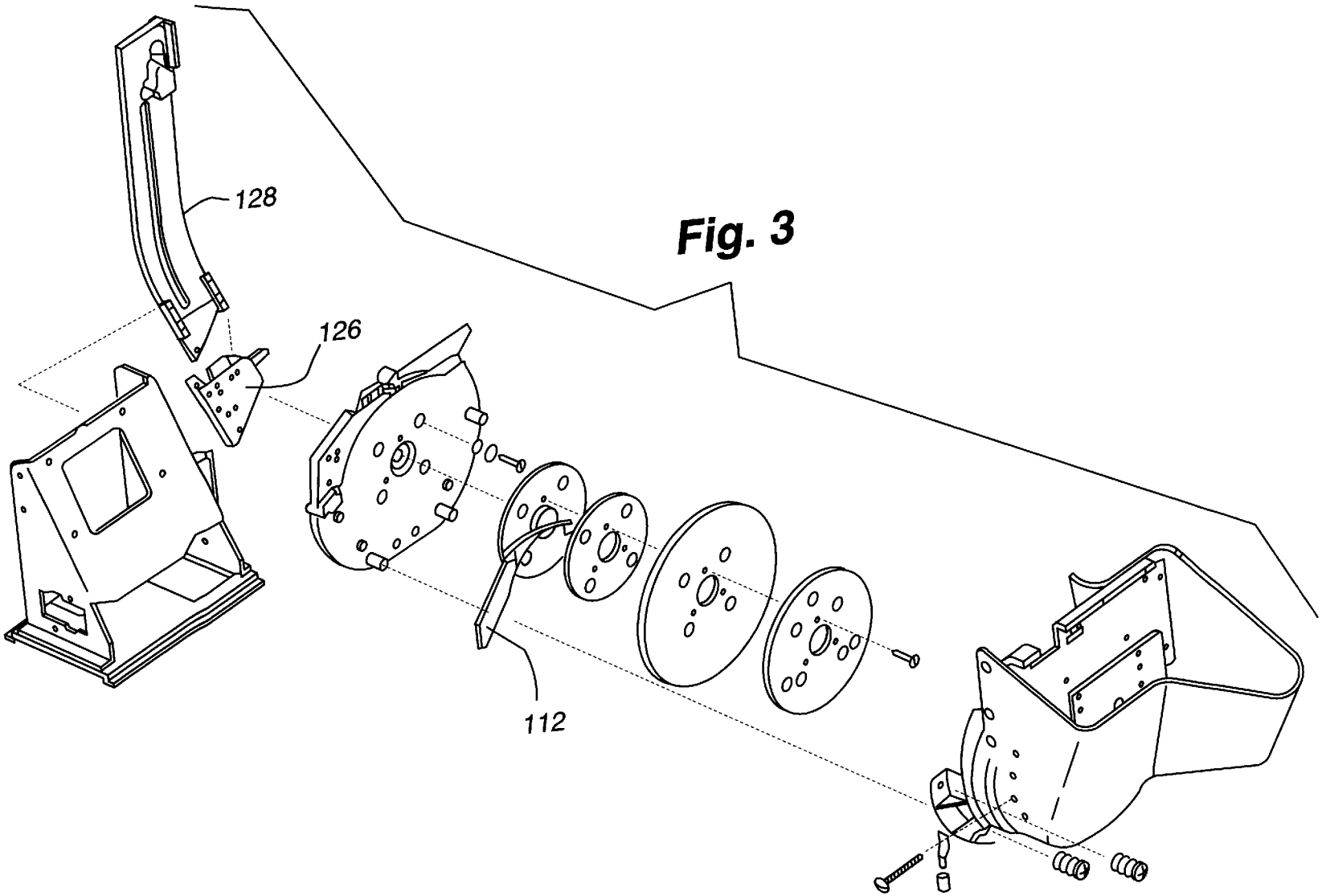
FIG. 3 is an exploded perspective view of an apparatus similar to that of FIG. 1 but with a coin escalator.

The embodiment of FIGS. 1–3 are specific to a particular coin size, i.e. a particular coin diameter and thickness, in the sense that other coin denominations placed in the bowl 102 would typically cause jams, ejection failures and/or unacceptably frequent miscounts downstream. Accordingly, in previous devices, machines accommodating different coin denominations had different physical characteristics such as the diameter and thickness of the shelf wheel 106, thickness of knife edge 112, height, circumferential and radial spacing of the pins 109 and the like.

Another previous coin handling device is described in U.S. Pat. No. 5,167,571. In this device, coins, rather than being supported on only one coin face, are positioned between two parallel discs, contacting the two coin faces, respectively: a circumferentially grooved stationary backplate and a rotating disc. In this device, the rotating disc contains coin holes through which coin pass to the inter-disc space. Coin pushers project from the back surface of the disc. According to the disclosure of U.S. Pat. No. 5,167,571, coins of different thickness may be handled with the same machine by adjusting the axial position of the backplate with respect to the disc.

Figure 4:
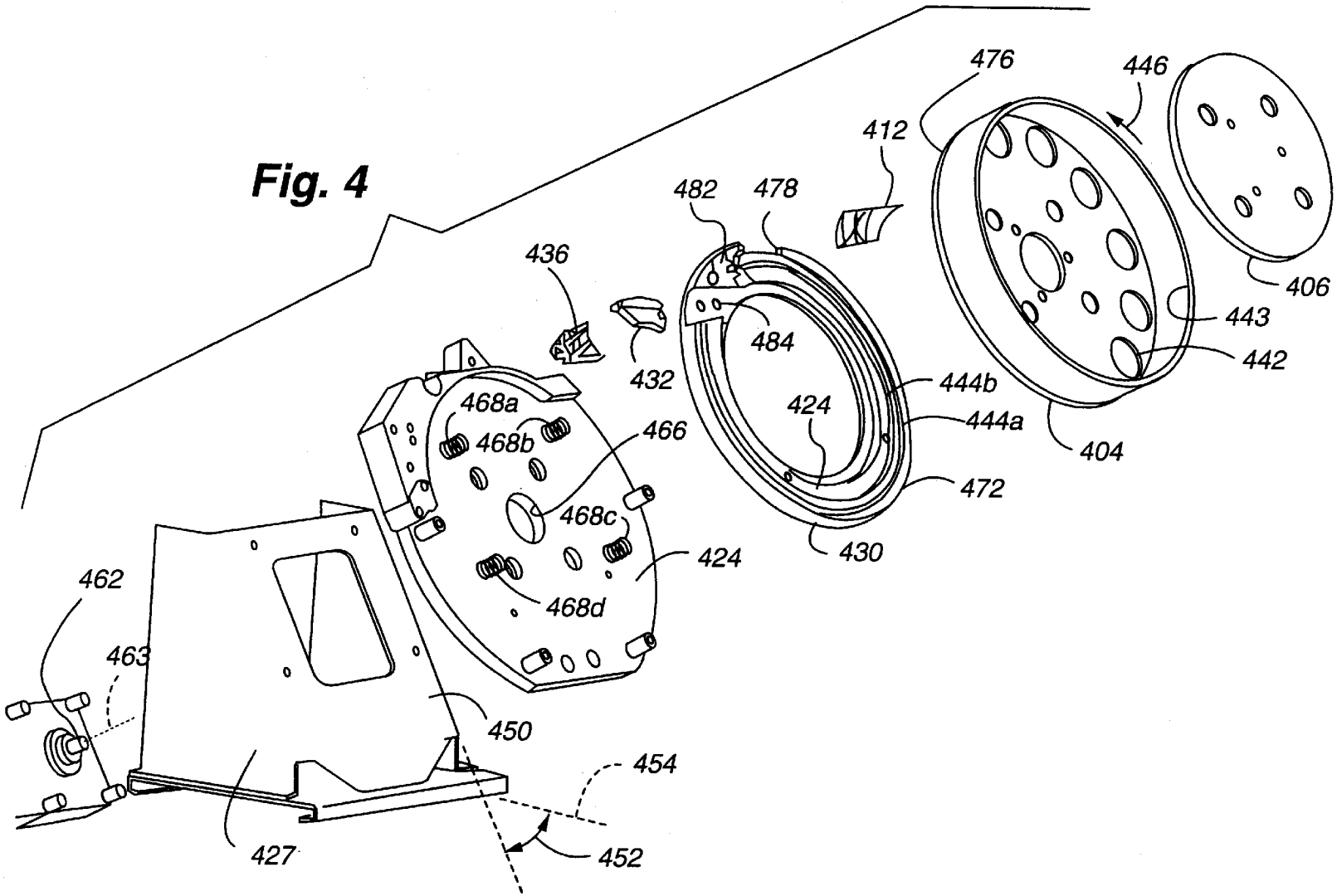
FIG. 4 is an exploded perspective view of a coin output hopper with a spring-mounted backplate.

FIG. 4 depicts an apparatus, according to an embodiment of the present invention, which is able to accommodate a range of coin sizes. Features which contribute to achieving such accommodation of the range of sizes are the placement of the pins or pushers protruding from the back side of the pin wheel 404, the spring suspension of the backplate 430, the configuration of the coin retainer 432 and the configuration of the knife, all of which are described more thoroughly below. In the following, the term "pins" includes both the elongated structures depicted (sometimes called "pushers") and cylindrical or peg-like structures.

Figure 5:
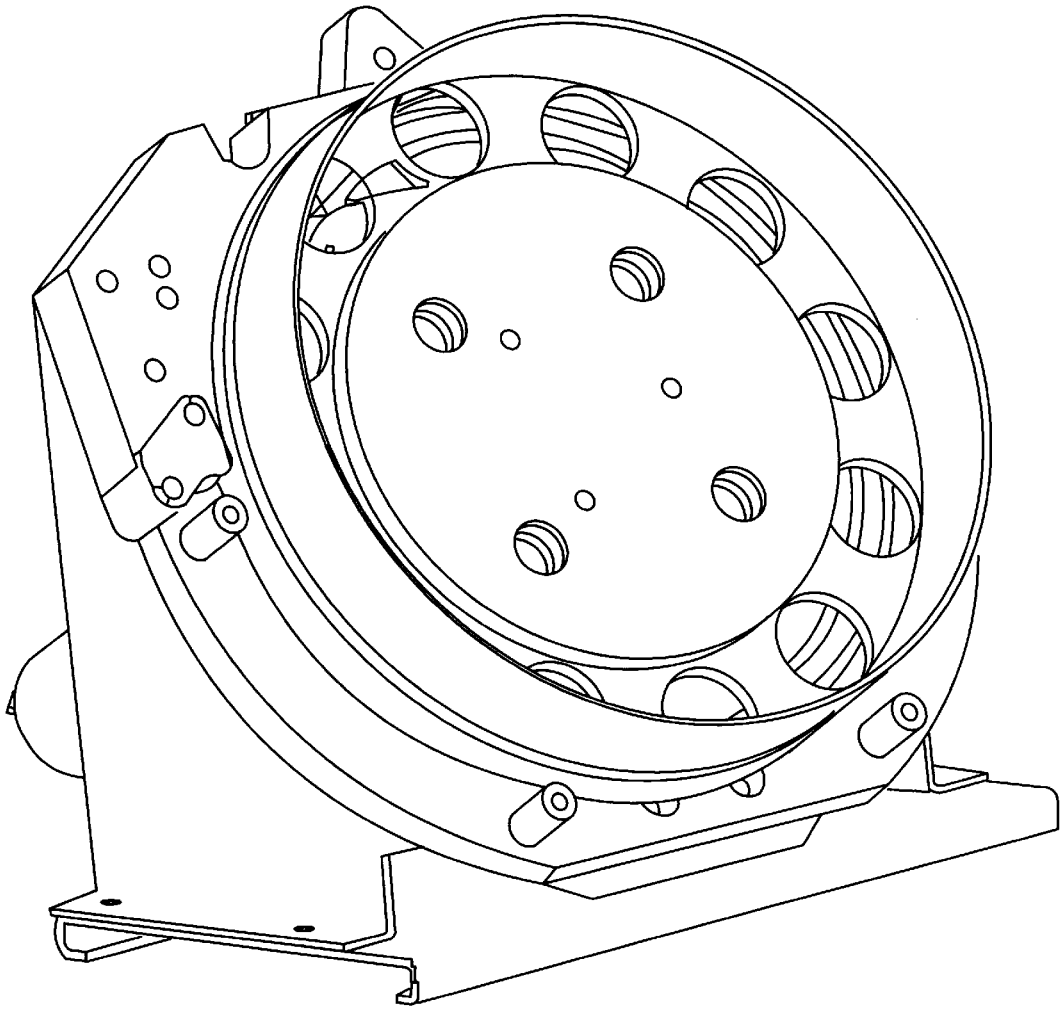
FIG. 5 is a perspective view of a output hopper, according to an embodiment of the present invention.

For clarity, the coin bowl is not depicted in FIGS. 4 and 5. The coin bowl can, in general, have a configuration similar to that of the bowl depicted in FIG. 1.

In the device depicted in FIG. 4, the chassis 427 defines a first surface 450 at an angle 452 of about 60 degrees to the horizontal 454. A housing 424 is mounted to the chassis parallel to the surface 450 with the shaft 462 of a motor protruding through opening 466 of the housing. A backplate 430, having substantially circular grooves 444*a*, 444*b*, is mounted above the housing 424, substantially parallel thereto and such that the circular grooves 444*a*, 444*b* are substantially concentric with the axis of the motor shaft 462. The backplate 430 is mounted so as to substantially prevent rotation about the axis 463 but to permit a degree of tilting, in any direction, with respect to the plane of the hopper housing 424, against the urging of suspension springs 468*a, b,c,d.*

Figures 15A, 15B, 15C:
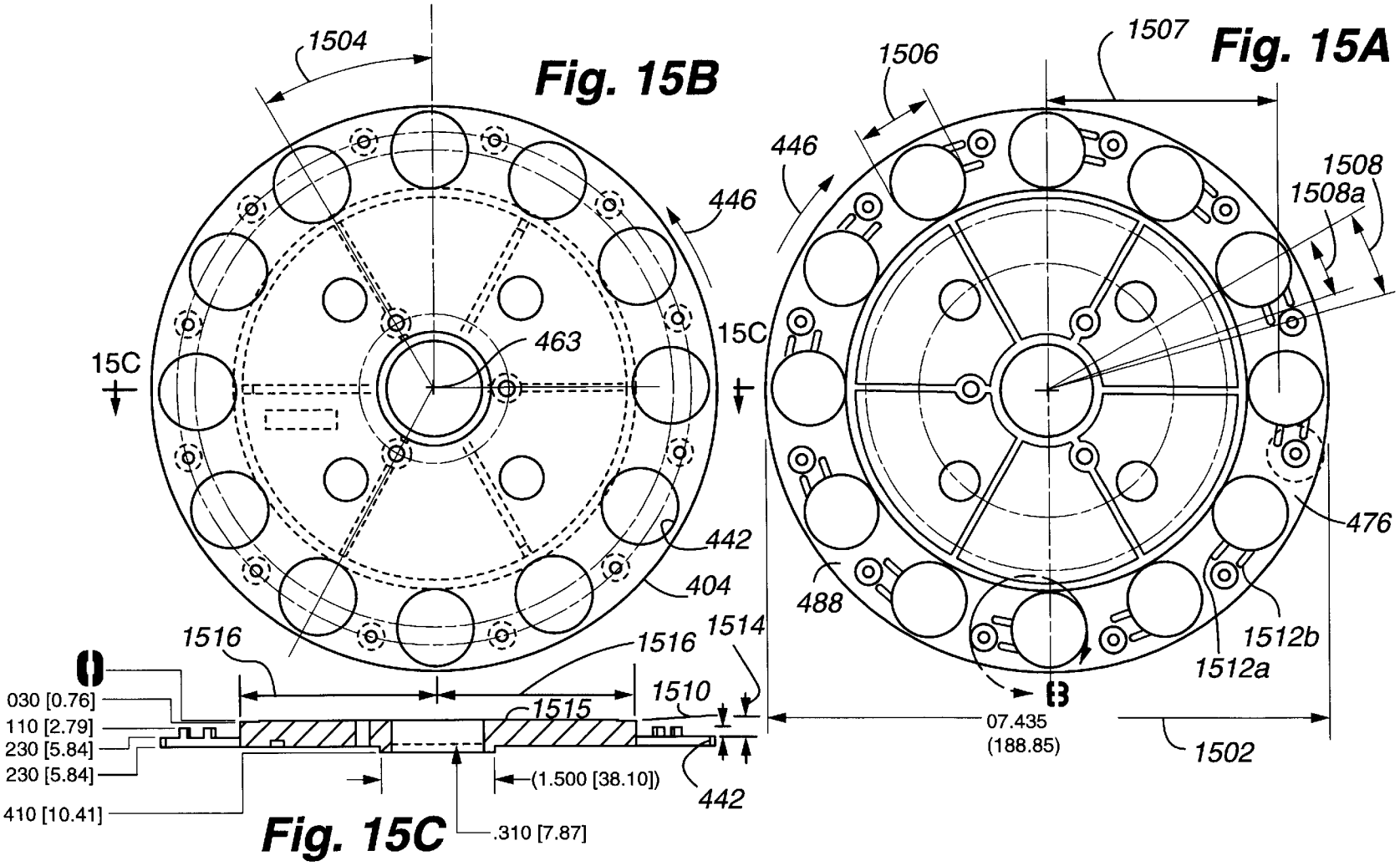
FIGS. 15A and 15B are rear and front elevational views of a pinwheel, according to an embodiment of the present invention.
FIG. 15C is a cross-sectional view taken along line 15C—15C of FIG. 15B.
Figure 16A:
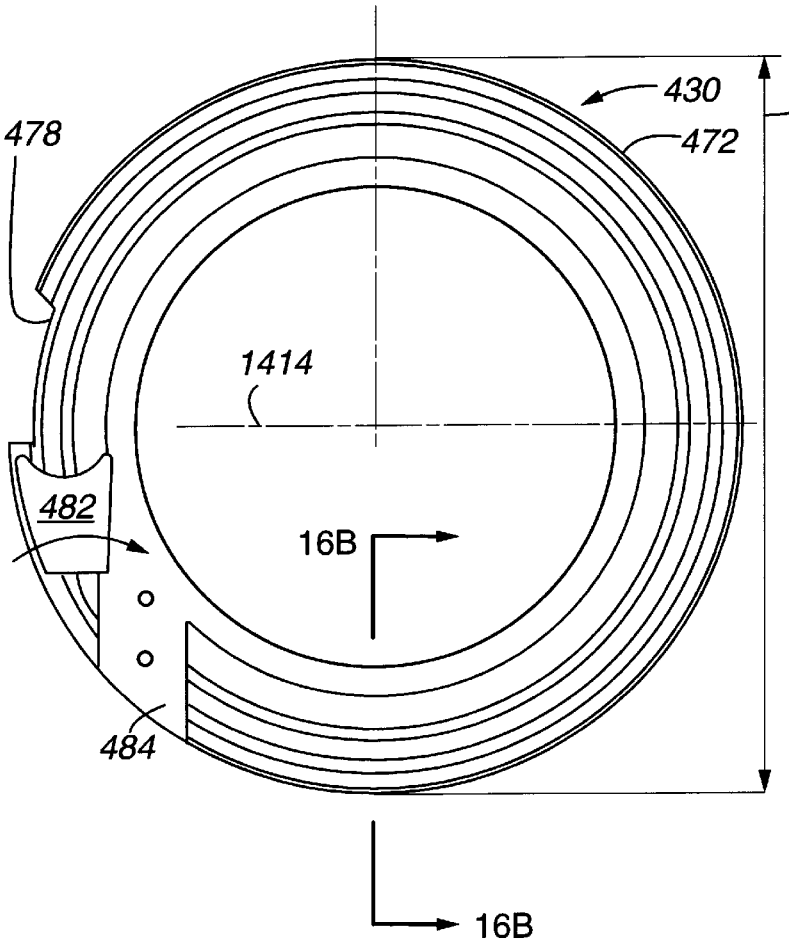
FIG. 16A is a front elevational view of a backplate, according to an embodiment of the present invention.
Figure 16B:
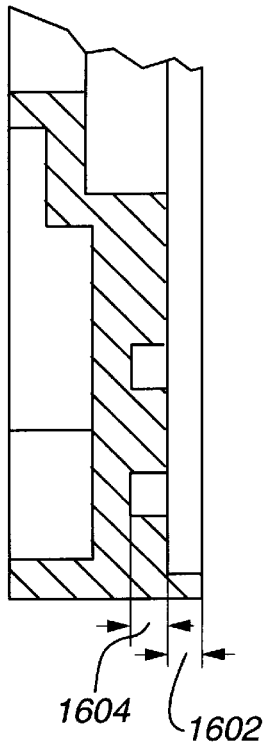
FIG. 16B is a cross-sectional view taken along line 16B—16B of FIG. 16A.

In the depicted embodiment, the rim 472 of the backplate 430 projects outwardly axially a distance above the coin contact plane 474 of the backplate, to contact the rim of the back surface 476 of a pin wheel 404. A disk-shaped or annular projection extending rearwardly from the rear surface of the pin wheel defines, in co-operation with the rim 472, an annular coin track. The height of the rim 472 defines the spacing between the coin contact plane 474 of the backplate and the back surface of the pin wheel. The backplate 430 contains a first cutout 478 for accommodating a coin retainer 432, a window 482 for accommodating a coin deflector 436 and recess 484 for accommodating a coin knife 412. The pin wheel 404 is coaxially coupled to the motor shaft 462 to rotate, e.g., in a counterclockwise direction 446. In addition to access/mounting holes, the disc of the pin wheel contains a plurality, such as twelve, preferably evenly-spaced circular coin holes 442 near its perimeter. The coin holes 442 have a diameter large enough to allow passage therethrough of the largest-diameter coin to be handled by the device. If desired, the disk of the pinwheel (e.g. as depicted in FIG. 15C) may be formed separately from the cylindrical collar 443. A shelf wheel or region 406 assists in directing coins from the bowl to the holes 442, for passage therethrough.

In general, the apparatus of FIGS. 4 and 5 operates by allowing entry of a coin through a coin hole 442 so that it is retained in the space between the back surface of the pin wheel disc and the front surface of the backplate 430. Accordingly, spacing between the front surface of the backplate 430 and the back surface of the pin wheel 404 is at least such as to accommodate the thickest coin in the predetermined range of coin sizes to be handled by the device of FIGS. 4 through 5.

Once a coin is positioned between pin wheel 404 and backplate 430, pins protruding from the back surface of the rotating pin wheel 404 and riding within grooves 444*a*, 444*b* formed in the backplate, contact the edge of a coin and push the coins along a generally circular path in a counterclockwise direction 446 so that the coin eventually contacts, in order, the coin retainer 432, deflector 436 and knife 412.

Because the springs 468 urge the rim of the non-rotating backplate 472 against the rim of the rotating pin wheel 404, the backplate 430 is free to tilt, with respect to the plane of the housing 424 so as to be constantly substantially parallel to the back surface of the rotating pin wheel 404, even though the pin wheel 404 may be misaligned (such that its back surface is not perpendicular to the motor axis 463) or is warped or otherwise non-planar. This feature is important in accommodating a range of coin sizes in a cost-effective manner since, as coin sizes, particularly coin thicknesses are smaller, the tolerance for departures from parallelism of the backplate coin surface 474 and pin wheel back surface 488 becomes smaller. Put another way, in the absence of the spring-suspended or otherwise compliant backplate of the present device, a device which could accommodate both thick coins (such as a quarter or half dollar), and thin coins (such a dime) would have to be manufactured and constructed to such close tolerances (to avoid cracks or openings between the backplate and the pin wheel into which thin coins could become jammed) that the cost of such a high-tolerance device would be highly undesirable.

Figure 12:
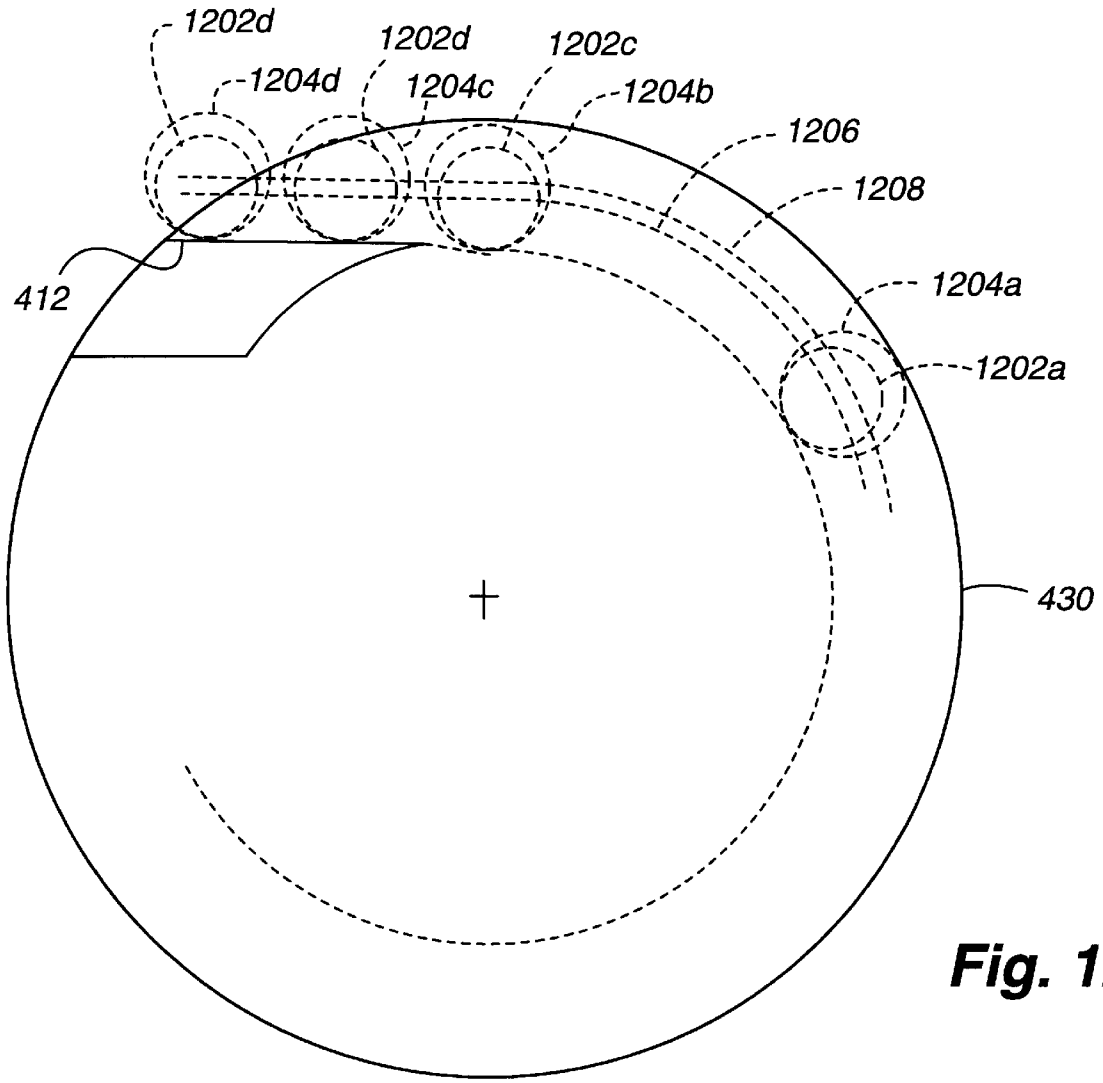
FIG. 12 depicts large and small coin paths according to an embodiment of the present invention.

To understand how the placement of pins is configured to accommodate a range of coin sizes, it is useful to understand the path of various sizes of coins as they move out of the coin hopper. FIG. 12 is a schematic depiction of a backplate 430 showing, in phantom lines, successive positions of a small coin 1202*a,b,c,d* and successive positions of a large coin 1204*a,b,c,d*. After the coin has passed through the pin wheel hole 442 and is engaged by pins of the pin wheel, the pins initially force the coins, as the pin wheel rotates, along a substantially circular path. Thus, for a first portion of its travel, the small coin 1202*a* moves in a fashion such that the path followed by its center point 1206 is initially substantially circular. When the edge of the coin contacts the knife edge 412, the coin thereafter moves in a linear fashion along the knife edge so that the subsequent path of the center of the small coin 1206 is linear. similarly, the center of the larger coin 1204 also follows a path 1208 which is initially circular and, later, linear. In contrast, the paths of the pins which contact the coins are always circular. Accordingly, during the first portion of coin travel, before the coins begin linear movement, a pin will contact a coin at a radial distance (with respect to rotation axis 463) which will remain substantially constant with respect to the center point of the coin. However, after the coin begins its linear movement along the knife edge 412, the pin will assume a position which is successively more radially inward with respect to the center of the coin as the coin moves along the knife edge. Put another way, the knife edge will force the coin to move transversely (although not strictly radially) outward with respect to the constant-radius movement of the pins.

Accordingly, several considerations are factors in determining pin placement for accommodating a range of coin sizes. Unless a pin which contacts a coin is positioned at a radius from the rotation axis 463 which is exactly equal to the radius of the coin center, the pin will exert a force on the coin which has a radial component as well as a tangential component. If the pin is radially inward of the coin center, there will be a radially outward force component. If the pin is radially outward of the coin center, there will be a radially inward component. If the radially inward component or radially outward component is too large, there is a potential for coin jamming, i.e. forcing the coin radially outward against the backplate rim 472 or radially inward in an undesirable fashion. Once the coin reaches the knife edge, a too-large radially inward force component can jam the coin into the edge of the central protrusion 1515 or into the edge of the knife blade and a too-large radially outward component can jam the coin into the rim 472 or can lift the coin off the knife blade. It has been found that, in the apparatus of the present invention, for a given coin size, and a given point along the coin path, there is a radius range from an outer radius greater than the radius of the coin center to an inner radius less than the radius of the coin center, such that placement of pins in such radius range will avoid too-large a radial component of force.

Unfortunately, the force analysis becomes more complex when there is an attempt to accommodate a range of coin diameters. First, the acceptable radial pin position must avoid too-large a radial component for any size coin in the desired coin range. As seen in FIG. 12, the coin center path for a larger coin is different from that for a smaller coin. Thus, it is possible that a pin position which would be acceptable for a larger coin (e.g. a pin position near the center line of the large coin 1208) would be radially too far outward to accommodate a smaller coin 1202 (i.e. would be so far radially outward from the path 1206 of the small coin center line point that the radially inward component of the force would jam the coin against the knife edge 412.) Similarly, a pin position which might be acceptable for a small coin may produce a radially outward force component on a large coin that would be unacceptable. Preferably, the range of coin sizes which will be handled by the machine is selected so that there is at least some overlap among one acceptable pin positions for each coin in this coin size range.

Complicating the analysis even further is the fact, noted above, that the radial position of a pin with respect to the center of the coin changes as the coin moves along the linear path defined by knife edge 412. Accordingly, it is possible that a pin position which results in a radial force within an acceptable range for a given coin, as the coin moves along the circular portion of the path, will produce a radial force on the coin which would be unacceptable as the coin moves along the linear portion of its path.

In some configurations, it is desired to provide a movement force to the coins along a substantial portion of the linear part of the coin path. However, since, as noted above the coin centers of linearly moving coins move radially outward with respect to circularly moving pins, a given pin eventually loses contact with the coin. One approach is to provide two or more pins associated with each coin position and situated such that as one pin moves to a position, with a respect to the coin center line, where it is no longer effective to produce the force of the desired magnitude and direction, another pin is, by then, in a position to contact the coin so as to provide the desired force.

In addition to the location, radially, of the centers of the pins, design of pin position, according to the present invention, also includes consideration of the length, height and width of the pins. Pin length (or placement) in the tangential or circumferential direction should be so as to prevent more than one coin entering a given coin pocket. This is because it is desired to push the coins out of the hopper one at a time in order to retain better control. Pin width and height should be large enough to withstand any jams without breaking and should be able to sustain operation over the anticipated life of the hopper without excessive wear. Too large a cross-section is believed to be detrimental in that, typically, a larger pin width or height requires an increase in the size of the groove of the backplate and the knife, and it is believed that larger grooves may impede movement of coins e.g. rolling of coins along the knife blade as the coin exits from the hopper.

The number of pins per coin pocket is related to how far down the coin path it is desired to actively push the coins using the coin pins. The distance over which active pushing is desired will be affected by how coins are treated as they exit the hopper, such as whether the device will be a side-eject hopper or will use an escalator similar to that depicted in FIG. 3 (128), which typically requires active pushing over a longer extent.

Additional pins may be provided adjacent a pocket for additional functions. For example, placing a pin below (radially inward of) the primary pin 1512*a* may assist by providing a sweeper function wherein the sweeper pin will push out any undersized coins or slugs that reached the hopper. If such undersized coins are not dealt with, the primary pin will be positioned relatively high (radially outward) with respect to the center of such undersized coin, thus providing an undesirably high radially inward component of force and potentially crushing or jamming the undersized coin or slug into the radially inward boundary of the coin path.

Extending this concept further, it can be seen that providing additional pins can also be useful in expanding the range of the hopper, although at the cost of additional pin grooves. Pins positioned below (radially inward of) the primary pin will allow the hopper to operate with smaller coins, while pins above the primary pin will allow larger coins to be used.

From the above, it is apparent that it is difficult to design pins which will not only provide the desired magnitude and direction of force over both the circular and linear portions of the coin path, but will do so for a range of coin sizes. FIG. 15A depicts pin configurations according to one embodiment of the present invention.

The particular dimensions chosen for an implementation of the present invention will depend in part on the size of the smallest and largest coins (i.e. the range of coin sizes or denominations) to be accommodated. FIGS. 13A–17B depict the components of a device which can accommodate coins in the size range between a U.S. five-cent piece ("nickel") and a U.S. 25-cent piece ("quarter"). Table I provides some of the important dimensions for items shown in these figures.

TABLE I

Dimensions for FIGS. 13A–17B

| Part | Item | Dimension |
|---|---|---|
| Deflector | Height 1302 | .94 in (23.8 mm) |
| Deflector | Length 1304 | .886 in (22.5 mm) |
| Deflector | Thickness 1306 | .375 in (9.52 mm) |
| Backplate, Knife and Deflector | Radius range of outer groove 1308a | 3.389–3.499 in (86–88.9 mm) |
| Backplate, knife and deflector | Radius Range of inner groove 1308b | 3.07–3.18 in (78–80.7 mm) |
| Deflector | Radius of upper edge 1310 | 3.63 in (92.2 mm) |
| Knife | Length of top edge 1402 | 2.07 in (52.7 mm) |
| Knife | Thickness 1404 | .26 in (6.7 mm) |
| Knife | Depth of grooves 1408a, 1408b | .15 in (3.8 mm) |
| Knife | Angle of declination 1404 to a parallel to 9 O'Clock line 1406 | 2.8 degrees |
| Knife | Distance of leading edge 1412 from 12 O'Clock line 1414 | .4 in (10.4 mm) |
| Pinwheel and Backplate | Diameter 1502 | 7.435 in (188.85 mm) |
| Pinwheel | Angular spacing between coin holes 1504 | 30 degrees |
| Pinwheel | Diameter of Coin holes 1506 | 1.005 in (25.53 mm) |
| Pinwheel | Radial placement of Coin Hole centers 1507 | 3.155 in (80.14 mm) |

TABLE I-continued

Dimensions for FIGS. 13A–17B

| Part | Item | Dimension |
|---|---|---|
| Pinwheel | Angular distance from coin hole center to outer pin leading edge 1508a | 11 degrees |
| Pinwheel | Angular distance from coin hole center to inner pin leading edge 1508 b | 14 degrees |
| Pinwheel | Height of pins 1510 | .12 in (3.05 mm) |
| Pinwheel | Radius range of inner pins 1512a | 3.08–3.17 in (78.24–80.52 mm) |
| Pinwheel | Radius range of outer pins 1512b | 3.4–3.9 in (86.3–88.6 mm) |
| Pinwheel | height of central protrusion above rim 1514 | .23 in (5.84 mm) |
| Pinwheel | Radius of central protrusion 1516 | 5.3 in (134.8 mm) |
| Backplate | Height of rim above coin support surface 1602 | .08 in (2 mm) |
| Backplate | Depth of groove below coin support surface 1604 | .08 in (2 mm) |
| Coin Guide | length of shelf 1702 | 1.6 in |
| Coin Guide | Depth of Shelf 1704 | .45 in (11.6 mm) |

Figure 6:
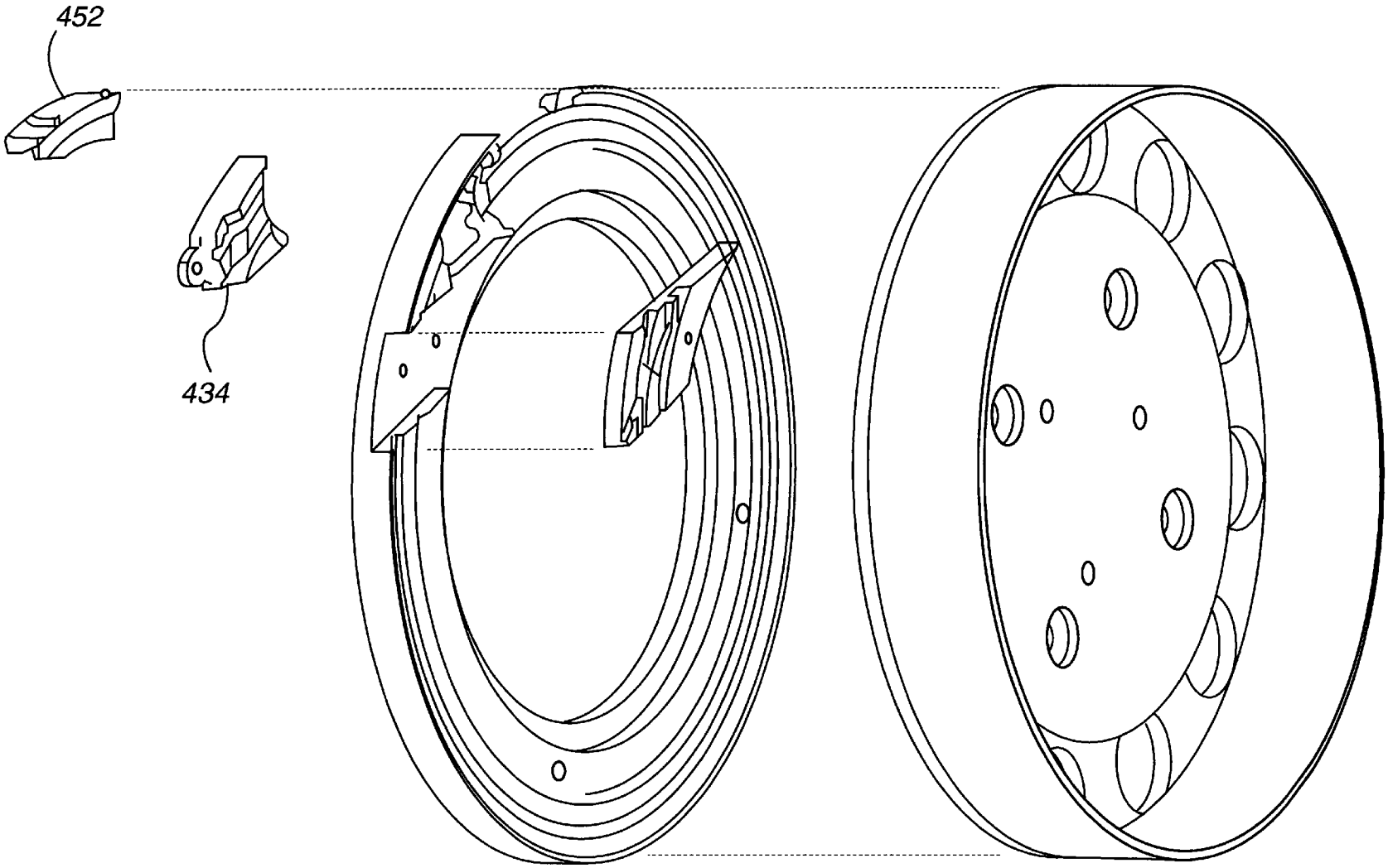
FIG. 6 is an exploded view of a holey wheel, backplate, knife, deflector and coin guide of the embodiment of FIG. 5.

FIG. 6 depicts the configuration and placement of the deflector 436 and the coin guide 432. As the coin travels to an approximately 12 o'clock position on the backplate, the coin guide 432 forces the coin into a position seated in a preferred location in the coin pocket (with the pocket being defined by the backplate coin contact surface 474 and pin wheel rear surface 488 in the axial direction, by the pin wheel disk protrusion 1515 and the backplate rim 478 in the radial direction and by pins 1512*a,b* in the circumferential direction). In one embodiment, the coin guide 432 acts to position the coin as far toward the axis of rotation as possible (i.e. adjacent the edge of the disk protrusion 1515). The coin guide 432 also serves to force the coin (circumferentially) against a coin contact pin.

Figures 17A, 17B:
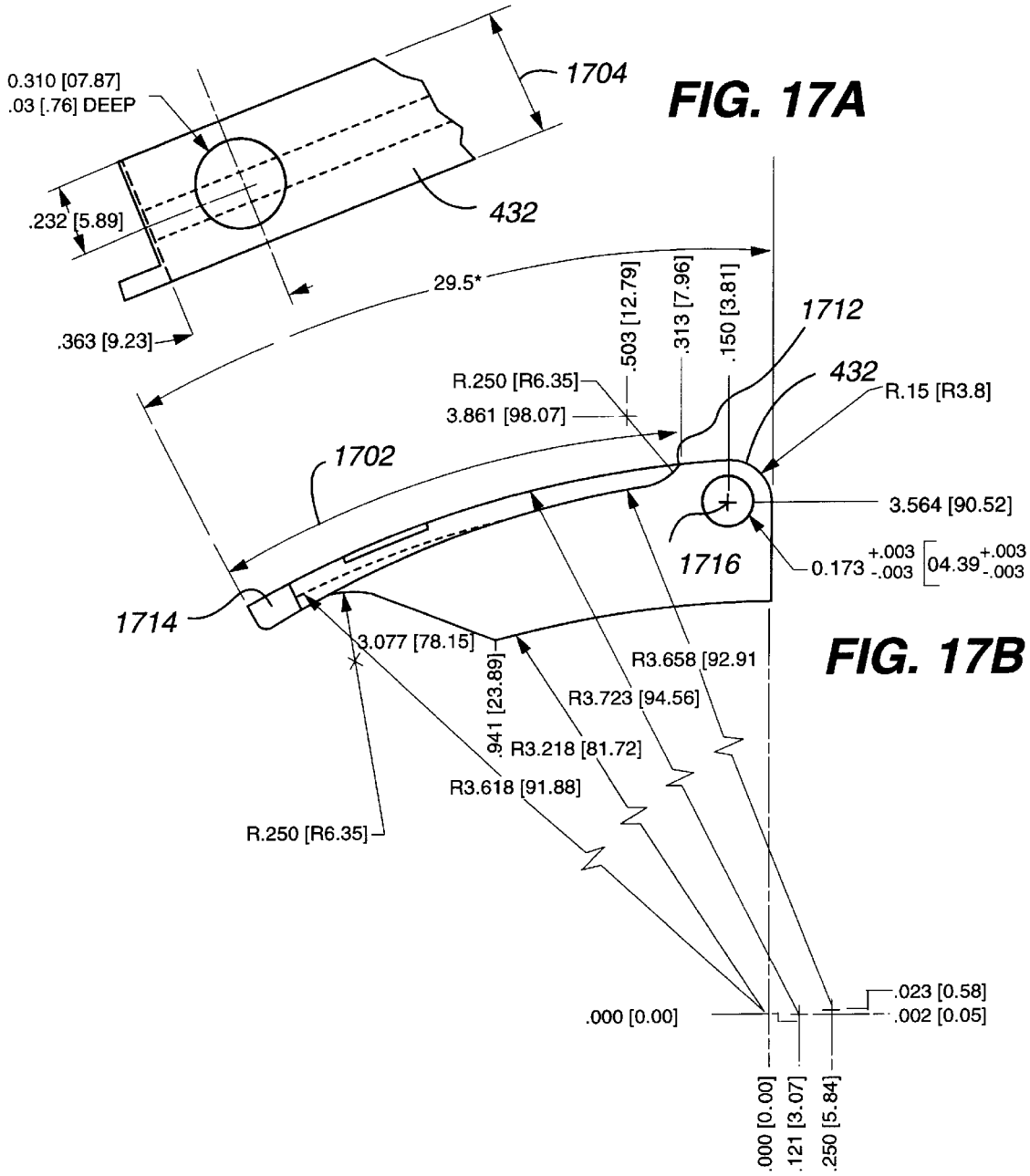
FIGS. 17A and 17B are top plan and elevational views of a coin guide according to an embodiment of the present invention.
Figure 18:
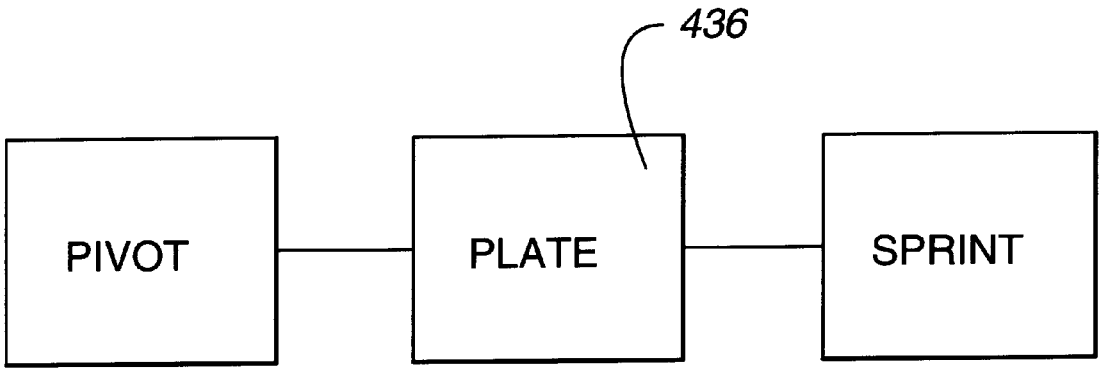
FIG. 18 depicts a spring for a deflector and a pivot for the deflector in accordance with an embodiment of the present invention.

The particular geometry of the coin guide depicted in FIGS. 17A and 17B illustrates the geometry of the coin guide contact surface which promotes its ability to engage coins of different diameters. Larger diameter coins are engaged near the leading edge 1712 of the guide ledge while smaller diameter coins are engaged closer to the trailing edge 1714 of the guide ledge.

In the embodiment depicted in FIGS. 17A and 17B, the circumferential extent of the coin guide is greater than that of previous coin guides. As a result, when the coin guide is urged pivotally downward about pivoting axis 1716, i.e., with the trailing edge 1714 moving generally toward the disk rotation axis 463 (e.g. by a spring, not shown), the trailing edge 1714 will be close to the rotation axis (compared as the trailing edge of previous devices, so as to engage smaller-diameter coins.

In addition to forcing or maintaining coins into the desired position within the coin pocket, the coin guide also serves to prevent secondary or tertiary coins from entering or partially entering the pocket, i.e. from becoming partially positioned in the space between the backplate and the disc, such as by partially blocking the region behind the coin hole.

After the coin has moved past the coin guide, the coin contacts the deflector 436. The deflector 436 continues the function of the coin guide (i.e. continues to maintain the coin positioned in the desired location of the coin pocket after the coin has left the influence of the coin guide) and also performs other functions. The deflector is urged to pivot axially outward, e.g. by a spring (not shown) mounted at the rear of the deflector causing the peak of the deflector 1312 to at least partially project through each hole 442 of the pin wheel as the hole rotates over the deflector, ejecting from the hole any coins which may be located within the hole (regardless of whether they have partially passed through the hole). The geometry of the deflector and the force exerted by the spring mounted at the rear of the deflector also serve to accelerate the exit of subsequent coins. By providing active acceleration rather than relying solely on acceleration of gravity, the coins which exit have a substantially more uniform velocity than coins which exit only under the influence of gravity (where the unpredictable effects of friction may have a greater relative effect). Providing for substantially constant exit velocity of the coins avoids inconsistent pulse widths in downstream detectors which could cause miscounts.

The knife 412 is also configured (compared to previous knife designs) to accommodate a range of coin sizes. Compared with previous knife configurations, among other differences, the configuration of FIGS. 14A and 14B has grooves 1408*a,b* positioned to match pin placement which is used (in the depicted embodiment) to accomodate a range of coin sizes, as discussed above.

By configuring the device to accomodate a range of coin sizes, e.g. as shown in the illustrated embodiment, a number of savings become possible. For example, in prior designs (where coin output hoppers were configured for a single denomination), converting, e.g., a 5¢ slot machine to a 25¢ slot machine required, among other steps, removing the 5¢ output hopper and installing a 25¢ hopper. Using the present invention, such conversion can be accomplished by performing such steps as replacing a 5¢ coin acceptor with a 25¢ coin acceptor, replacing or modifying control or accounting software and replacing signage or graphics, but without changing the coin output hopper.

Figure 7:
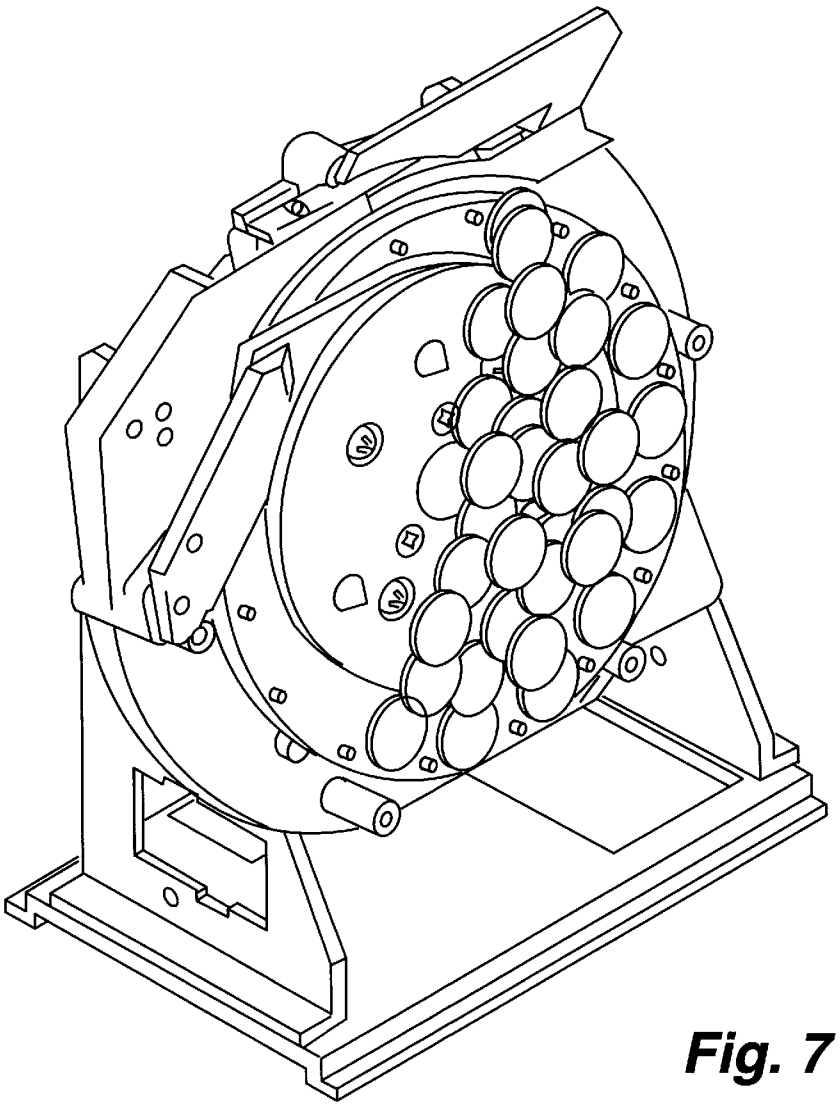
FIG. 7 depicts an assembled coin hopper similar to that depicted in FIG. 2 illustrating stacked coins.

Another feature of the present invention addresses one of the problems which arise from the tendency of coins to fully or partially adhere or stick together, particularly in a face-to-face fashion, which can cause a coin sheeting effect as depicted in FIG. 7. The prevalence of coin sheeting depends partially on the type or denomination of coin involved, certain coins being more prone to sheeting, e.g. owing to high friction surfaces (such as the U.S. nickel) and/or the particular embossing or printed patterns on the face of the coin such as the French franc. Sheeting of coins as depicted in FIG. 7 can lead to a number of types of problems including entry jams, particularly in the context of a device such as that depicted in FIG. 3, or other jams of coins against outer or inner rims, against knife edges and the like.

Figure 8B:
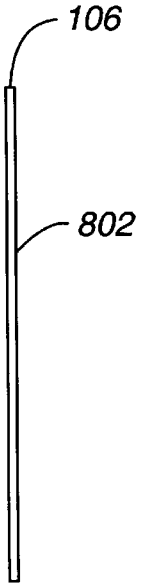
FIGS. 8A and 8B are front elevational and side elevational views of a shelf wheel of the type depicted in FIG. 7.
Figure 8A:
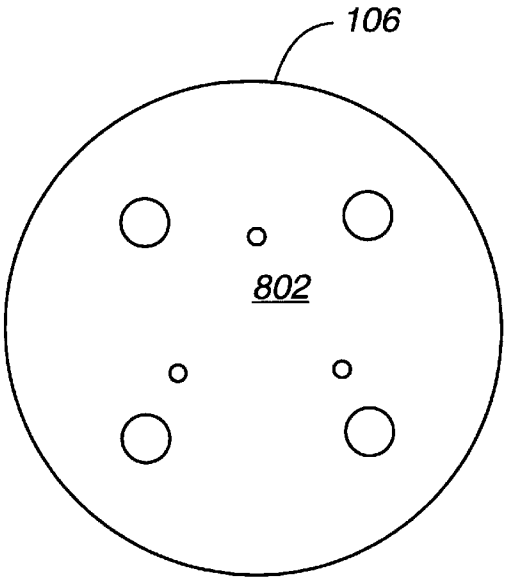

According to one embodiment of the invention, the incidence of sheeting is reduced or eliminated by providing a shelf wheel with a convex surface. As depicted in FIGS. 8A and 8B, previous shelf wheels had an outer surface 802 that was substantially flat and planar.

Figure 9B:
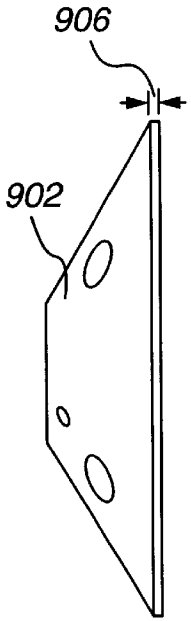
FIGS. 9A and 9B are front elevational and side elevational views of a conical shelf wheel according to an embodiment of the present invention.
Figure 9A:
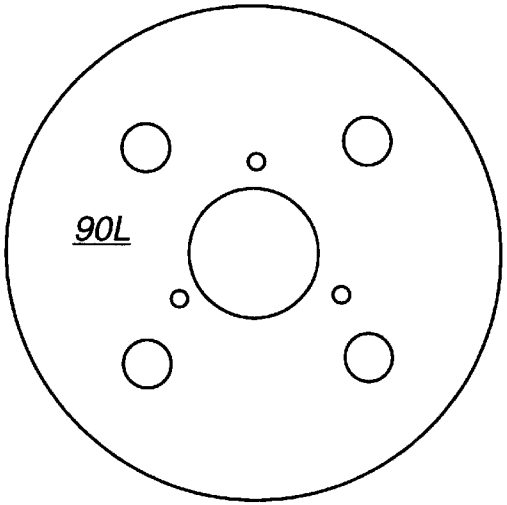

FIGS. 9A and 9B depict one embodiment of a convex-surfaced shelf wheel with the outer surface of the shelf wheel 902 defining the frustum of a cone. In the depicted embodiment, the rim 904 of the shelf wheel defines a cylinder with a thickness 906 about equal to or slightly less than that of the thickest coin to be handled.

Figure 10:
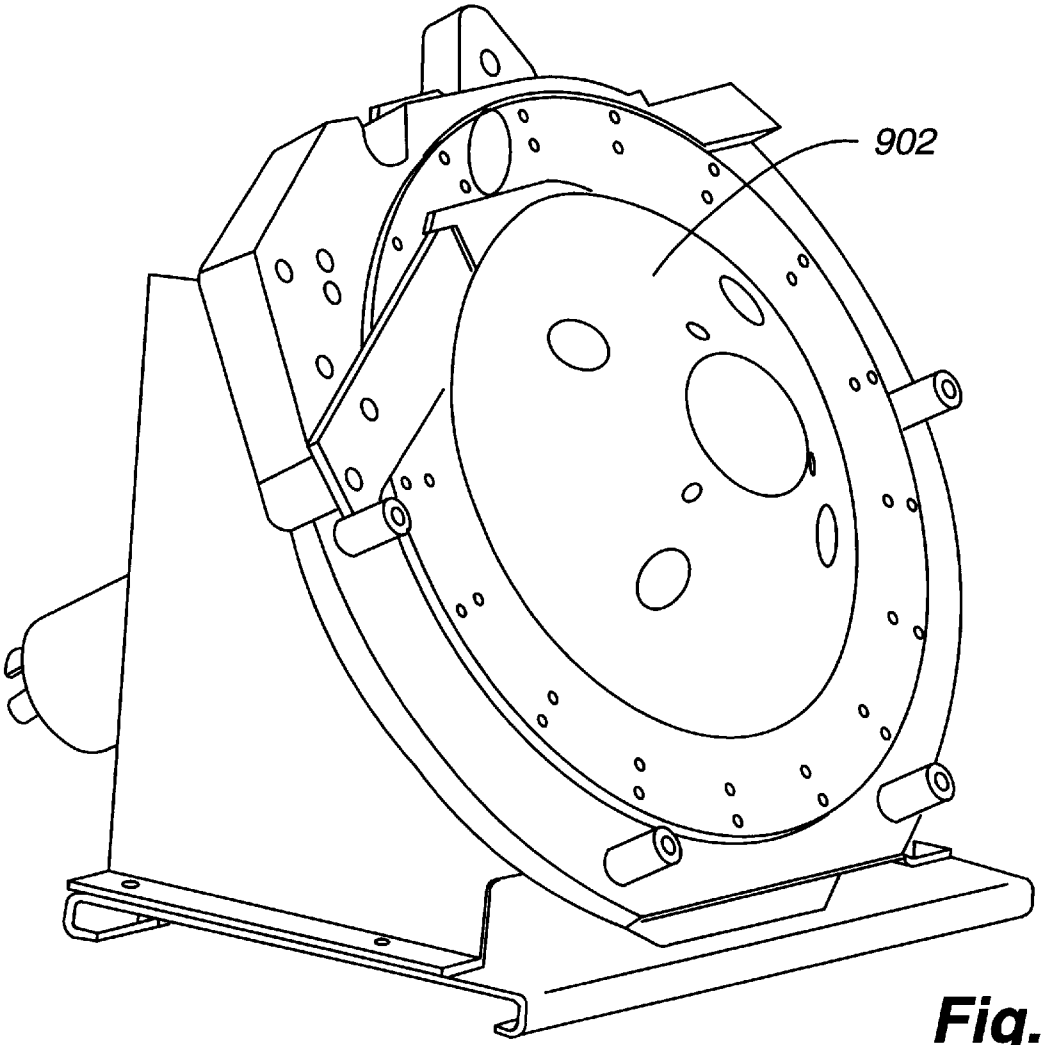
FIG. 10 is a perspective view of a coin hopper employing the shelf wheel of FIGS. 9A and 9B.
Figure 11:
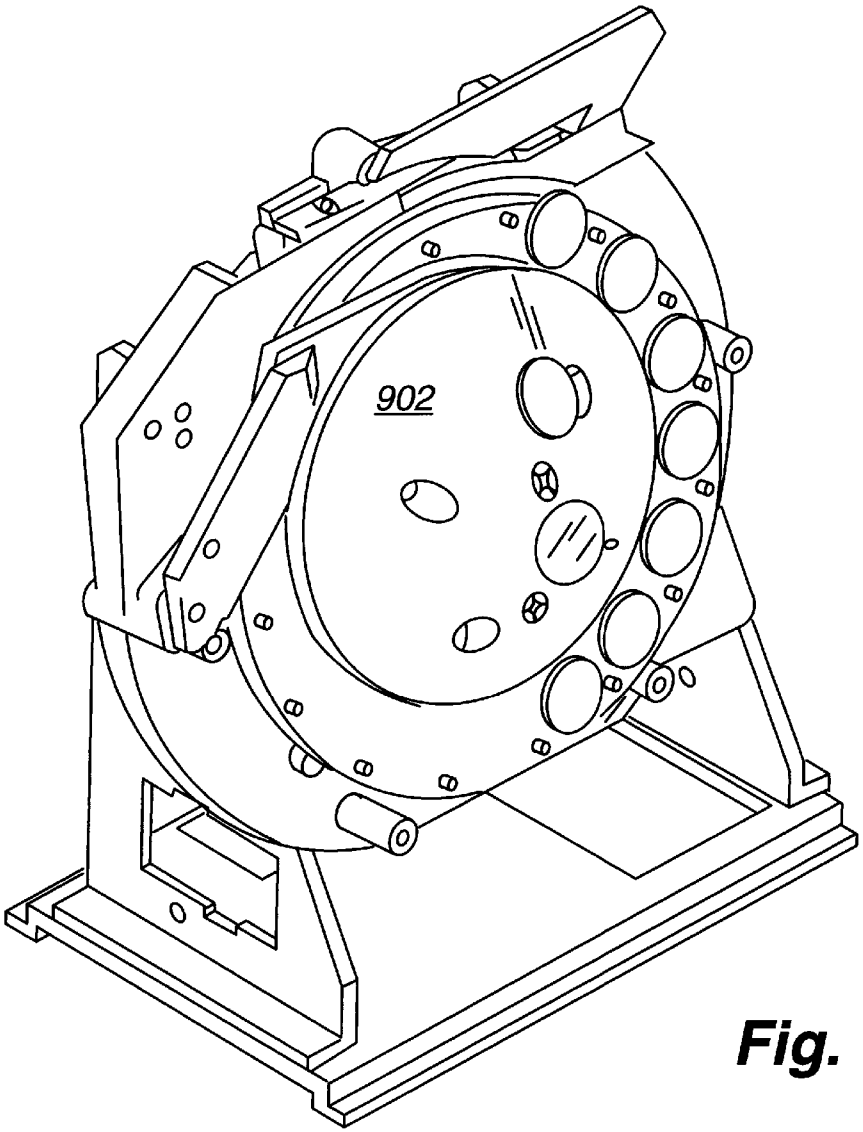
FIG. 11 is a perspective view of the coin hopper for FIG. 10 depicting interactions of coins with the shelf wheel.

FIG. 10 depicts an implementation of the shelf wheel in an otherwise traditional coin hopper, such as that depicted in FIG. 1. As seen in FIG. 11, coins which are positioned adjacent to the surface of the shelf wheel 902 will thus be discouraged from lying in parallel planes, to reduce or eliminate the incidence of sheeting.

In light of the above description, a number of advantages of the present invention can be seen. The present invention provides a coin output hopper/handler which can accommodate any of a plurality of coin sizes or denominations without requiring that the output hopper be adjusted, reconfigured or replaced when switching from one denomination to another denomination. In this way, when it is desired to convert, e.g. a slot machine or other gaming device from one denomination to another denomination (e.g. when it is desired to convert a nickel slot machine to a quarter slot machine) the conversion can be achieved without the need to replace, reconfigure or adjust the coin output hopper. In one embodiment, the reconfiguration can be achieved by changing or reconfiguring only the coin accepter, the software and the graphics indicating the denomination of the machine.

Preferably, the multi-denominational hopper of the present invention can be provided at relatively low cost such as without requiring extremely small (and expensive) manufacturing or fabrication tolerances. Preferably, the apparatus is configured to achieve or maintain a low jamming or other malfunction rate and to achieve high reliability and accuracy. The apparatus is configured to avoid excessive force in an undesired direction despite use with different sizes or diameters of coins. The present invention assists in positioning coins in desired pocket or other locations regardless of differing coin sizes. The present invention assists in ejecting coins from entry into undesired locations such as entry of secondary or tertiary coins into portions of the coin pocket and/or coin holes. The present invention provides compliance to coin discs regardless of minor misalignments or misshaping of the disc. The present invention assists in maintaining a more uniform exit velocity of coins to reduce or eliminate miscounts. According to one aspect, the present invention reduces or eliminates coin sheeting to, in turn, reduce or eliminate the occurrence of jams.

Other advantages of the present invention will be apparent to those of skill in the art after understanding the present disclosure.

A number of variations and modifications of the present invention can be used. Although the present invention has been described in the context of an output hopper for a gaming device, the present invention can be used in other contexts such as input devices, coin counting devices, vending machines and the like. Although the present invention has been defined in the context of handling coins, the invention could be used for handling other devices, including tokens, other regularly shaped objects such as buttons, washers and the like, irregularly shaped objects such as bolts, screws and the like. Although the present invention has been described as handling a single denomination at a time, (although capable handling different denominations at different times) the invention could also be used for handling two or more different sized objects such as two or more different coins, e.g. dimes and pennies.

A number of materials can be used in constructing the apparatus of the present invention. In one embodiment, the pin wheel is formed of about 10% glass-filled polycarbonate with silicon and teflon, such as that available from LMP under the trade designation DFL4536. In one embodiment, the back plate is formed of Noryl polyphenylene (PPL). The knife is preferably made of a hard or wear-resistant material such as steel.

In one embodiment, the present invention is configured such that three different coin hoppers are sufficient to accommodate all U.S. coin sizes. In this embodiment, a first configuration accommodates coins from the size of a U.S. dime to the size of a nickel; a second configuration accommodates coins from the size of a nickel to the size of a quarter; and a third configuration accommodates coins from the size of a quarter to the size of a U.S. "silver" dollar.

Although the present invention has been described by way of a preferred embodiment and certain variations and modifications, other variations and modifications can also be used, the invention being defined by the following claims.

What is claimed is:

1. A method for changing coin denominations in a gaming device from a first denomination having a first radius to a second denomination having a second radius, different from said first radius, comprising:

providing a gaming device including a coin acceptor configured for said first denomination, signage, a controller which uses control software, and an output hopper outputting a range of coin sizes, including the coin size of said first denomination and said second denomination, using said output hopper, said output hopper being configured for outputting said range of coin sizes;

modifying said coin acceptor, control software and signage to accommodate gaming in said gaming device using said second denomination in the absence of modifying said output hopper;

wherein said outputting a rang of coin sizes includes initially contacting a coin with a coin accelerator which then accelerates said coin along a linear exit path away from said coin accelerator means, and wherein said coin accelerator comprises a deflector that is urged to pivot axially outward, and that is urged towards contact with said coin by a spring mounted at a rear of said deflector.

2. A coin output hopper usable in a gaming device for outputting coins of a denomination selected from among a plurality of coin denominations including at least a first denomination having a first radius and a second denomination having a second radius, different from said first radius, comprising:

a container for holding a mass of coins with a first exit opening;

first and second spaced-apart plates defining an annular region therebetween, said first and second plates being spaced apart a distance at least equal to the thickness of the thickest of said plurality of coin denominations;

at least a first opening through said first plate sized to permit entry of a coin from said container, through said exit opening into said annular region;

at least first and second pins moveable through said annular region along a circular path about a first axis;

a knife, adjacent a portion of said annular region defining a coin exit path;

means for positioning said pins at a radial distance from said axis to contact the coin in said annular space and along at least a portion of said coin exit path so as to impart a force on said coin such that (a) said force has a radial component sufficiently small to avoid jamming, when said coin has said first radius and (b) said force has a radial component sufficiently small to avoid jamming when said coin has said second radius;

wherein jamming is avoided regardless of the size of the coin among said plurality of coin denominations and without the need for adjustment of the coin hopper; and a coin-accelerating means for initially contacting and then accelerating a coin away from said coin-accelerating means, wherein said coin accelerating means is urged to pivot axially outward, and wherein said coin-accelerating means is urged to pivot towards said first plate by a spring mounted at a rear end of said coin accelerating means.

3. An apparatus, as claimed in claim 2, further comprising means for positioning said coin in a radially innermost position in said annular region, regardless of the size of said coin in said plurality of coin denominations.

4. An apparatus as claimed in claim 2, further comprising means for maintaining said coin adjacent to at least one of said first and second pins regardless of the size of said coin in said plurality of coin denominations.

5. An apparatus as claimed in claim 2, further comprising means for preventing positioning a second coin in said annular space adjacent said first coin.

6. An apparatus as claimed in claim 2, further comprising means for ejecting a coin which is positioned at least partially in said first opening.

7. A coin hopper apparatus usable in a gaming device for outputting coins of a denomination selected from among a plurality of coin denominations, comprising:

a container for holding a mass of coins with a first exit opening;

first and second spaced-apart plates defining an annular region therebetween, said first and second plates being spaced apart a distance at least equal to the thickness of the thickest of said plurality of coin denominations;

at least a first opening through said first plate sized to permit entry of a coin from said container, through said exit opening into said annular region;

at least a first pin moveable through said annular region along a circular path about a first axis;

means for positioning said pin at a radial distance from said axis to contact the coin in said annular space so as to impart a force on said coin such that said force has a radial component sufficiently small to avoid jamming, regardless of the size of the coin among said plurality of coin denominations;

a knife, adjacent a portion of said annular region defining a coin exit path;

means for maintaining said second plate substantially parallel to said first plate regardless of misalignment or misshaping of said first plate, as said first plate rotates about said axis;

a coin-accelerating means for initially contacting and then accelerating a coin away from said coin-accelerating means, wherein said coin accelerating means is urged to pivot axially outward, wherein said coin-accelerating means is urged to pivot towards said first plate by a spring mounted at a rear end of said coin accelerating means, and wherein a peak of said coin accelerating means at least partially projects through said first opening when said first opening is adjacent to said rear end of said coin accelerating means.

8. An apparatus as claimed in claim 1, further comprising means for avoiding coin sheeting.

9. A coin output hopper comprising:

a chassis defining a first mounting plane inclined at about 30 degrees from vertical;

a plurality of springs mounted on said mounting plane a motor mounted on said chassis having an output shaft defining a rotation axis substantially perpendicular to said mounting plane;

a pinwheel, with a front and rear surface, mounted on said output shaft for rotation about said rotation axis, said pinwheel having twelve evenly-spaced circular holes positioned with the hole centers about 80 mm from said rotation axis, said holes having a diameter of about 25.53 mm, and having a central disk-shaped protrusion extending from the rear surface thereof, the disk-shaped protrusion having a diameter of about 135 mm, each of said holes having corresponding first and second pins spaced from the edge of said holes, protruding from said rear surface and spaced radially about 80 mm and about 87 mm respectively from said rotation axis, wherein a leading edge of each first pin is angularly spaced about 11 degrees from the center of the corresponding hole and a leading edge of each second pin is angularly spaced about 14 degrees from the center of the corresponding hole;

a backplate, positioned between said pinwheel and said mounting plane, and having a rim and an annular recess, said springs urging said backplate against said rear surface of said pinwheel, wherein said rim and said annular recess cooperate with said rear surface of said pinwheel and said disk-shaped protrusion to maintain said backplate substantially parallel to and spaced a predefined distance from said rear surface of said pinwheel, said backplate having concentric grooves sized and spaced to receive said first and second pins;

means for urging coins radially inward when positioned between said pinwheel and said backplate;

knife means for guiding coins out of said output hopper.

* * * * *